US010934035B2

(12) United States Patent
De Vita et al.

(10) Patent No.: US 10,934,035 B2
(45) Date of Patent: Mar. 2, 2021

(54) MACHINE FOR PACKAGING FLEXIBLE HOSES

(71) Applicant: SICA S.p.A., Alfonsine (IT)

(72) Inventors: Maurizio De Vita, Alfonsine (IT); Giorgio Tabanelli, Cotignola (IT)

(73) Assignee: SICA S.P.A., Alfonsine (IT)

( * ) Notice: Subject to any disclaimer, the term of this patent is extended or adjusted under 35 U.S.C. 154(b) by 141 days.

(21) Appl. No.: 15/571,527

(22) PCT Filed: May 4, 2016

(86) PCT No.: PCT/IB2016/052545
§ 371 (c)(1),
(2) Date: Nov. 3, 2017

(87) PCT Pub. No.: WO2016/178159
PCT Pub. Date: Nov. 10, 2016

(65) Prior Publication Data

US 2018/0141687 A1 May 24, 2018

(30) Foreign Application Priority Data

May 4, 2015 (IT) ..... BO2015A0224

(51) Int. Cl.
*B65B 11/04* (2006.01)
*B65B 25/24* (2006.01)
*B65B 63/04* (2006.01)

(52) U.S. Cl.
CPC ..... *B65B 11/045* (2013.01); *B65B 11/04* (2013.01); *B65B 25/24* (2013.01); *B65B 63/04* (2013.01)

(58) Field of Classification Search
CPC ..... B65B 25/24; B65B 11/04; B65B 11/045; B65B 63/04; B65B 27/06; B65B 49/12; B65B 49/08
See application file for complete search history.

(56) References Cited

U.S. PATENT DOCUMENTS 1,630,834 A * 5/1927 Derry ..... B65B 25/24 53/204
2,266,592 A * 12/1941 Eger ..... B65B 25/24 53/409

(Continued)

FOREIGN PATENT DOCUMENTS

| | | | |
|---|---|---|---|
| EP | 2612835 | A1 | 7/2013 |
| FR | 2493802 | A1 | 5/1982 |
| SU | 887363 | A1 | 12/1981 |

OTHER PUBLICATIONS

International Search Report dated Oct. 18, 2016 for PCT application No. PCT/IB2016/052545.

(Continued)

*Primary Examiner* — Robert F Long
*Assistant Examiner* — Eduardo R Ferrero
(74) *Attorney, Agent, or Firm* — Shuttleworth & Ingersoll, PLC; Timothy Klima

(57) ABSTRACT

A machine for packaging flexible hoses in a plastic film has a packaging station provided with an operating device for imparting to a coil of flexible hose a rotary motion around a rotation axis, and an orienting device for imparting to the plastic film an oscillatory motion around a fulcrum axis substantially transverse to the rotation axis of the coil.

8 Claims, 4 Drawing Sheets

(56) References Cited

U.S. PATENT DOCUMENTS 2,274,745 A * 3/1942 Schultz ..... B65B 11/04 53/118
2,716,315 A * 8/1955 Jacoby ..... B65B 11/04 53/587
3,044,532 A * 7/1962 Ghisoni ..... B65B 11/04 156/361
4,173,108 A * 11/1979 Eglinton ..... B65B 11/04 53/211
4,281,500 A * 8/1981 Mueller ..... A01F 15/071 53/211
4,283,903 A * 8/1981 Mayhall ..... B65B 11/04 53/211
4,299,076 A * 11/1981 Humphrey ..... B65B 11/045 198/412
4,409,776 A 10/1983 Usui
4,662,151 A * 5/1987 Mathes ..... A01F 15/071 53/118
5,203,139 A 4/1993 Salsburg
5,212,933 A * 5/1993 Cere' ..... B65B 11/025 53/556
5,216,873 A * 6/1993 Ratzlaff ..... A01F 15/0715 53/118
5,365,723 A * 11/1994 Ramos ..... B65B 11/045 53/211
5,400,567 A * 3/1995 Lindstrand ..... B65B 27/06 53/399
5,430,995 A * 7/1995 Cere ..... B65B 11/045 53/556
5,447,008 A * 9/1995 Martin-Cocher ..... B65B 11/025 53/399
5,564,258 A * 10/1996 Jones, Sr. ..... B65B 11/008 53/399
5,628,167 A * 5/1997 Huson ..... B65B 11/04 53/210
6,393,808 B1 * 5/2002 Kallner ..... B65B 11/025 53/135.3
6,688,076 B1 * 2/2004 Rivera, Jr. ..... B65B 11/04 53/204
6,705,060 B1 * 3/2004 McGuinness ..... B65B 25/24 53/204
8,191,337 B2 6/2012 Moore
2002/0124529 A1 * 9/2002 van der Lely ..... A01F 15/071 53/411
2003/0097940 A1 * 5/2003 Mazzoni ..... B65B 27/06 100/2
2007/0204564 A1 * 9/2007 Lancaster, III ..... B65B 11/006 53/399
2011/0236520 A1 * 9/2011 Tabanelli ..... B29C 57/025 425/392
2013/0168485 A1 * 7/2013 Balzanelli ..... B65H 54/62 242/472.5

OTHER PUBLICATIONS

Russian Search Report dated Aug. 1, 2019 for Russian application No. 2017141451/10 (071820).

* cited by examiner

MACHINE FOR PACKAGING FLEXIBLE HOSES

TECHNICAL FIELD

The present invention relates to a machine for packaging flexible hoses.

BACKGROUND ART

In the field of packaging of flexible hoses, it is known to provide a machine comprising a feeding wheel which is mounted to rotate about a first substantially horizontal rotation axis and is provided with a plurality of winding pins (in this case, three winding pins) mounted to rotate about respective second rotation axes substantially parallel to each other and to the first rotation axis. Each winding pin is advanced by the feeding wheel in succession and intermittently, first through a winding station, where the hose is wound to form a coil of flexible hose axially delimited by two side faces substantially parallel to each other and perpendicular to the relative second rotation axis, then through a packaging station, where the coil of flexible hose is packaged in an extensible plastic film, and finally through an unloading station, where the coil of flexible hose packaged in the extensible plastic film is unloaded from the machine. The packaging station is provided with a horizontal carriage, which is mounted to make straight movements in a feeding direction substantially parallel to said rotation axes, and has a support pin whose longitudinal axis is parallel to the feeding direction and which is configured to receive and hold a reel of extensible plastic film. Once locked a free end of the extensible plastic film between the end windings of the coil of flexible hose, the coil of flexible hose is wrapped in the extensible plastic film normally combining the movements of the reel of extensible plastic film in the feeding direction with the rotation of the coil of flexible hose about the respective second rotation axis.

The machines for packaging flexible hoses of the aforesaid known type have some drawbacks, mainly deriving from the fact that these machines are unable to feed the extensible plastic film on the inner areas of the side faces of the coil of flexible hose and, therefore, to pack correctly coils of hose with side faces having a relatively large radial width.

The machines for packaging flexible hoses of the aforesaid known type have, moreover, some further drawbacks due to the fact that:

stretching the extensible plastic film is not sufficient to ensure its adherence on the side faces of the coil of flexible hose, which therefore has a relatively reduced stability;

the extensible plastic film must be wound in multiple layers on the coil of flexible hose, with a relatively high material consumption, to ensure a sufficient compactness of the coil of flexible hose; and once applied to the coil of flexible hose, the extensible plastic film has two side flaps, which do not adhere to the side faces of the coil and therefore cause imperfections and problems of handling and storage of the coil.

DISCLOSURE OF INVENTION

The object of the present invention is to provide a machine for packaging flexible hoses which is free from the aforesaid disadvantages and which has a simple and economic implementation.

According to the present invention, it is provided a machine for packing flexible hoses as claimed in the attached claims.

BRIEF DESCRIPTION OF THE DRAWINGS

The present invention will be now described with reference to the accompanying drawings, which show a non-limiting embodiment, in which.

BEST MODE FOR CARRYING OUT THE INVENTION

Figure 1:
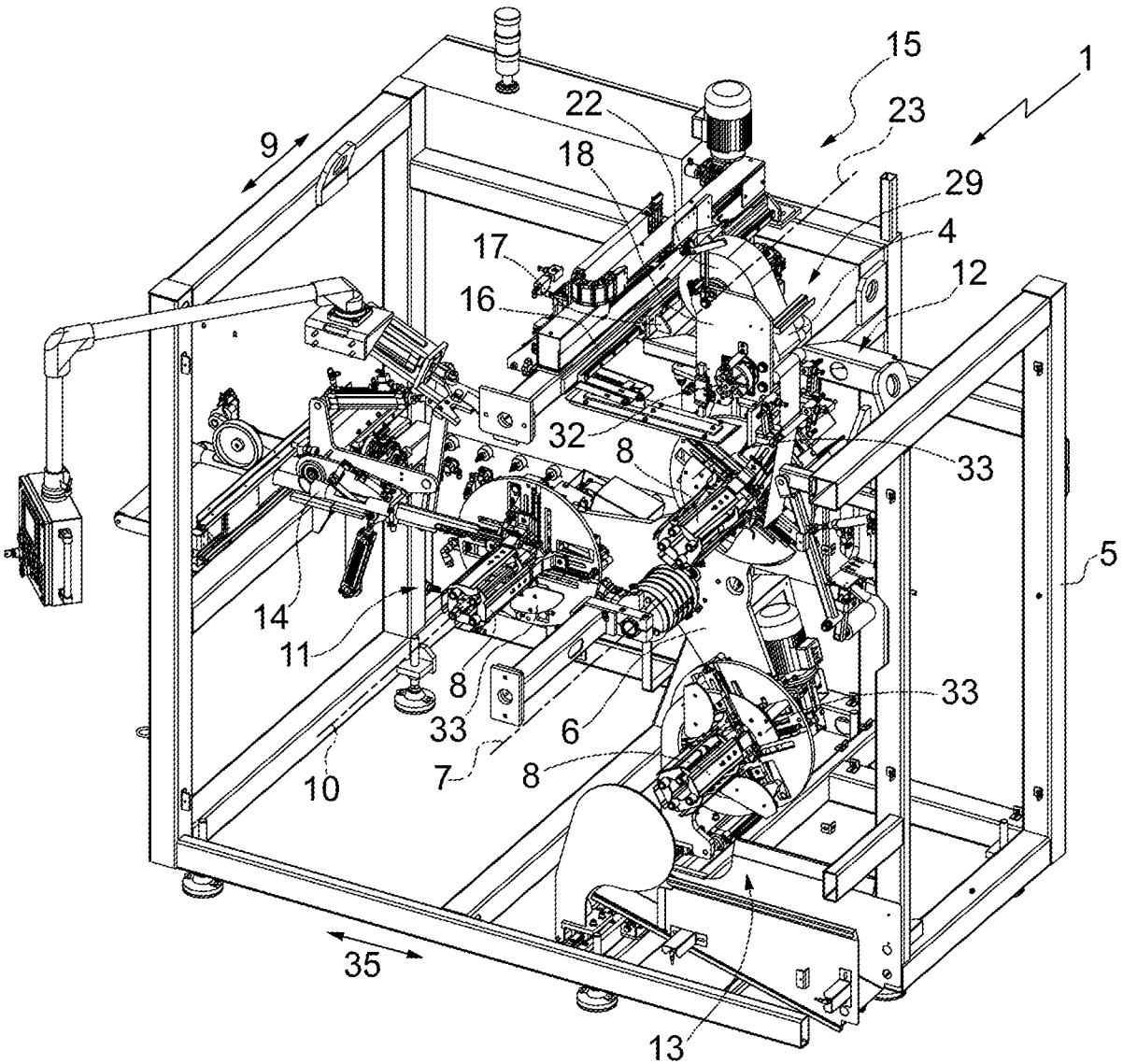
FIGS. 1 and 2 are two perspective schematic views, with parts removed for clarity's sake, of a preferred embodiment of the machine of the present invention.
Figure 2:
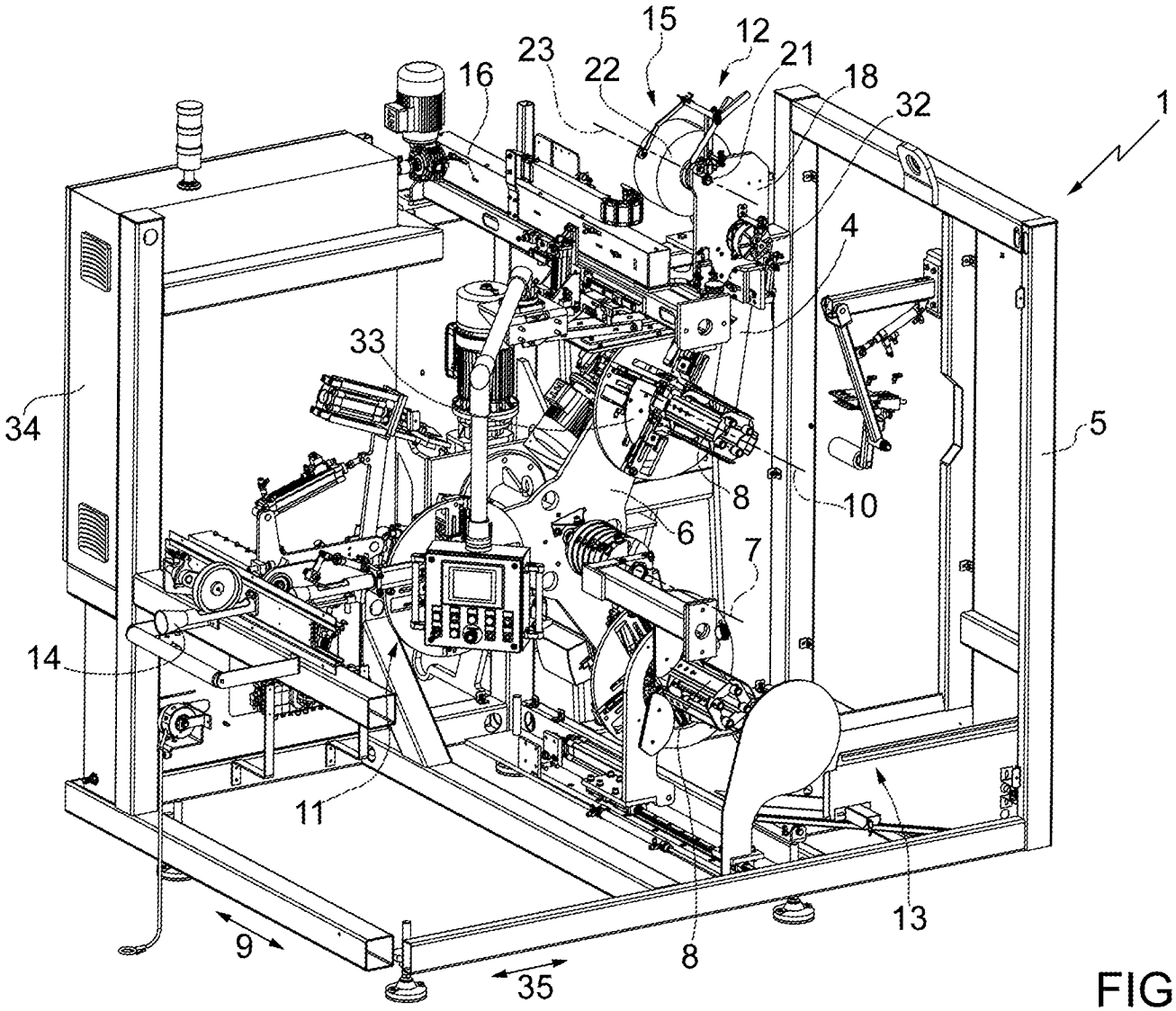

With reference to FIGS. 1 and 2, 1 indicates, as a whole, a machine for packaging coils 2 of flexible hose 3 (FIGS. 3 and 4) in an extensible plastic film 4.

The machine 1 comprises a support frame 5 and a feeding wheel 6 mounted to rotate in an intermittent manner, with respect to the frame 5 and under the thrust of a known and not shown operating device, about a substantially horizontal rotation axis 7.

The wheel 6 is provided with a plurality of winding pins 8 of the known type (in this case three winding pins 8), which protrude from the wheel 6 in a direction 9 parallel to the axis 7, and are uniformly distributed around the axis 7.

Each pin 8 is mounted to rotate about a rotation axis 10 parallel to the axis 7 and to the direction 9, and is fed in succession by the wheel 6 first through a winding station 11, where the flexible hose 3 is wound around the pin 8 to form the coil 2, then through a packaging station 12, where the coil 2 is packaged in the film 4, and finally through an unloading station 13, where the coil 2 packaged in the film 4 is unloaded from the machine 1.

The flexible hose 3 is fed to the station 11 by a known and not shown extrusion machine, and along a feeding channel 14 mounted on the frame 5 transverse to the axes 7, 10.

The station 12 is provided with a packaging unit 15 comprising a straight guide 16, which is fixed to the frame 5 and is parallel to the direction 9, is mounted above the wheel 6, and supports a carriage 17 movable along the guide 16 in the direction 9.

Figure 3:
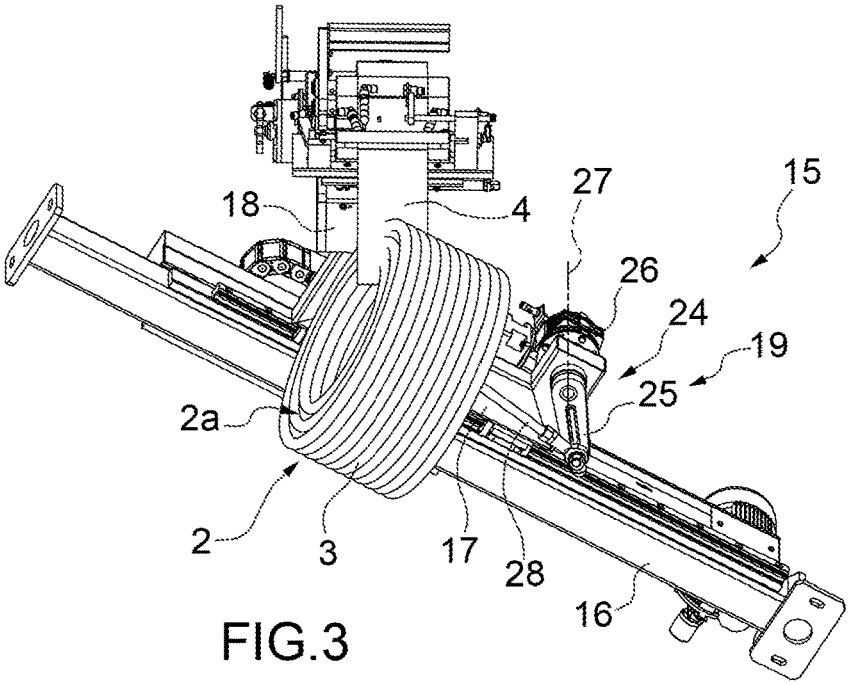
FIGS. 3, 4, and 5 are three perspective schematic views, with parts removed for clarity's sake, of a detail of the machine of FIGS. 1 and 2.
Figure 4:
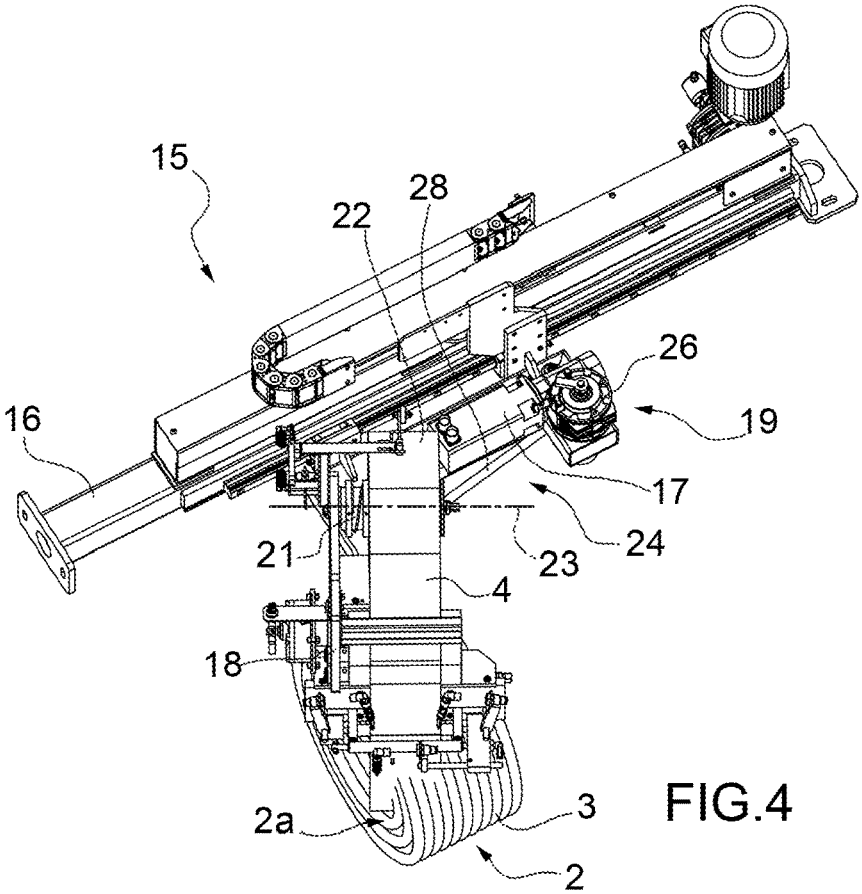
Figure 5:
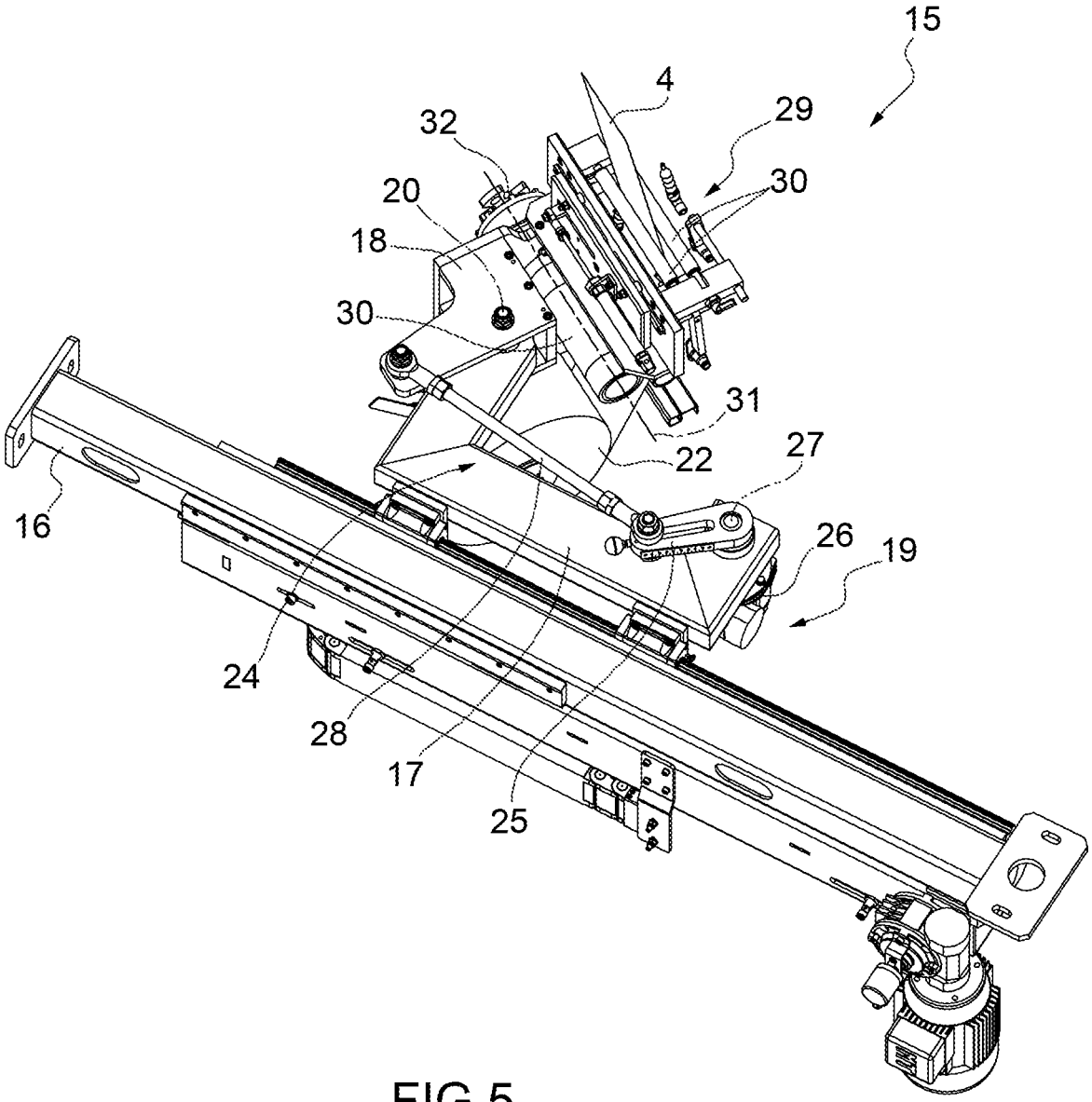

As shown in FIGS. 3, 4, and 5, the carriage 17 supports a swinging platform 18, which is rotatably coupled to the carriage 17 to move, relative to the carriage 17 and under the thrust of an operating device 19, around a fulcrum axis transverse to the direction 9, in particular perpendicular to the axis 10 of the pin 8 each time arranged in the station 12.

The platform 18 is provided with a support pin 21, which is rotatably engaged by a reel 22 of film 4, and has a horizontal longitudinal axis 23 whose orientation depends on the position of the platform 18 about the axis 20.

The device 19 comprises, in this case, a crank mechanism 24 comprising, in turn, a crank 25 mounted on the carriage 17 to rotate, with respect to the carriage 17 and under the thrust of an electric motor 26, around a rotation axis 27 parallel to the axis 20, and a connecting rod 28 interposed between the crank 25 and the platform 18.

The continuous rotary motion of the crank 25 is converted by the connecting rod 28 in a reciprocating oscillatory motion of the platform 18, and then of the reel 22 of film 4.

The unit 15 is further provided with an unwinding device 29 comprising a plurality of unwinding rollers 30 idly mounted on the platform 18 to rotate about respective rotation axes 31 parallel to the axis 23, one of which is associated with a braking device 32 for selectively controlling the stretching of the film 4.

In use, the free end of the film 4 is locked against one of the side faces 2*a* of the coil 2 perpendicular to the axis 10 by means of a locking jaw 33 slidingly connected to the pin 8 to make straight movements along the pin 8 in the direction 9.

Now, the coil 2 is packaged in the film 4 by combining the rotation of the pin 8 about the respective axis 10 with the oscillation of the platform 18, and therefore of the reel 22 around the axis 20 and, preferably but not necessarily, with the movement of the carriage 17 along the guide 16. The aforesaid movements are selectively controlled by an electronic control unit 34 of the machine 1.

The coil 2 dragging the film 4 and the oscillation of the film 4 around the axis 20 allow wrapping in the film 4 also the two side faces 2*a* of the coil 2.

The machine 1 has some advantages, mainly deriving from the fact that the oscillation of the reel 22 and, therefore, of the film 4 around the axis 20, allows:

a proper package of coils 2 with side faces 2*a* having a relatively large radial width;

ensuring a relatively high stability of the coils 2 packaged in the film 4 during the unwinding of the flexible hose 3;

subjecting the film 4 to a relatively reduced stretching thus preventing its break;

ensuring the adherence of the film 4 on the side faces 2*a* of the coils 2; and ensuring a sufficient compactness of the coils 2 with a relatively small number of layers of film 4, and a relatively low material consumption.

According to a variant not shown, the packaging unit 15 is movable in a horizontal direction 35 transverse to the direction 9 and/or around a rotation axis parallel to the direction 9 to selectively control the relative position between the coil 2 of flexible hose 3 and the reel 22 of film 4.

The invention claimed is:

1. A machine for packaging flexible hoses, the machine comprising:

a packaging station including a packaging unit;

a rotatable feeding wheel mounted to rotate in an intermittent manner about a horizontal rotation axis and suitable for feeding a coil of flexible hose into the packaging station;

an operating device including a plurality of winding pins protruding from the feeding wheel in a direction parallel to the rotation axis and mounted in the packaging station that rotates a coil of flexible hose around the rotation axis; and the packaging unit mounted in the packaging station to wrap a plastic film around the coil of flexible hose, wherein the packaging unit comprises a swinging platform that causes the plastic film to oscillate around a fulcrum axis that is transverse to the rotation axis, a support pin for a reel of plastic film that is mounted to the swinging platform to be oscillated around the fulcrum axis, and an operating device that imparts an oscillatory motion around the fulcrum axis to the swinging platform, wherein the operating device comprises a crank mechanism having a crank that is mounted to rotate around a further rotation axis for rotary motion that is parallel to the fulcrum axis of the support pin, and a connecting rod that turns the rotary motion of the crank into an oscillatory motion of the swinging platform, wherein the connecting rod converts continuous rotary motion of the crank into reciprocating oscillatory motion of the swinging platform;

wherein the connecting rod translates in a plane orthogonal to the fulcrum axis;

wherein the connecting rod includes a first end and an opposing second end, the connecting rod being hinged at the first end to the crank and pivotally connected at the second end to a pin attached to the swinging platform to be hinged at the second end to the swinging platform.

2. The machine according to claim 1, further comprising:

an electronic control device to combine the rotation of the coil of flexible hose around the rotation axis with the oscillation of the plastic film around the fulcrum axis.

3. The machine according to claim 1, wherein the swinging platform is mounted to make straight movements in a first feeding direction that is parallel to the rotation axis of the coil of flexible hose.

4. The machine according to claim 1, wherein the swinging platform is mounted to make straight movements in a second feeding direction that is transverse to the rotation axis of the coil of flexible hose.

5. The machine according to claim 1, the packaging unit further comprising:

an unwinding device that unwinds the plastic film from the reel of plastic film, the unwinding device comprising at least one unwinding roller that is mounted to rotate around a longitudinal axis of the at least one unwinding roller; and a brake that controls a rotation speed of the at least one unwinding roller around the longitudinal axis and that stretches the plastic film.

6. The machine according to claim 1, further comprising;

a winding station that winds the flexible hose into the coil of flexible hose; and an unloading station that unloads the coil of flexible hose packaged in the plastic film from the machine.

7. The machine according to claim 6, wherein the winding pin is mounted to rotate around the rotation axis;

wherein the operating device further comprises;

a feeding wheel that mounts and feeds the winding pin in succession and intermittently through the winding, packaging and unloading stations.

8. The machine according to claim 1, and further comprising:

two side faces that are perpendicular to the rotation axis, wherein the coil of flexible hose is axially delimited by the two side faces; and a locking jaw that moves between a clamped position of a free end of the plastic film against one of the two side faces of the coil and a release position.

* * * * *